US008870680B2

(12) United States Patent
Yamamoto

(10) Patent No.: US 8,870,680 B2
(45) Date of Patent: Oct. 28, 2014

(54) GOLF CLUB HEAD AND GOLF CLUB

(71) Applicant: Dunlop Sports Co. Ltd., Kobe (JP)

(72) Inventor: Akio Yamamoto, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 94 days.

(21) Appl. No.: 13/644,078

(22) Filed: Oct. 3, 2012

(65) Prior Publication Data

US 2013/0102411 A1 Apr. 25, 2013

(30) Foreign Application Priority Data

Oct. 25, 2011 (JP) ..... 2011-234193

(51) Int. Cl.
*A63B 53/04* (2006.01)

(52) U.S. Cl.
CPC ..... *A63B 53/04* (2013.01); *A63B 2053/0458* (2013.01); *A63B 53/0466* (2013.01); *A63B 2053/042* (2013.01); *A63B 2053/0412* (2013.01)
USPC ..... 473/345

(58) Field of Classification Search
USPC ..... 473/345
See application file for complete search history.

(56) References Cited

U.S. PATENT DOCUMENTS

| | | | | |
|---|---|---|---|---|
| 6,386,990 | B1 | 5/2002 | Reyes et al. | |
| 7,497,789 | B2 * | 3/2009 | Burnett et al. | 473/342 |
| 2002/0006836 | A1 | 1/2002 | Helmstetter et al. | |
| 2002/0091015 | A1 * | 7/2002 | Seki et al. | 473/345 |

FOREIGN PATENT DOCUMENTS

| | | | |
|---|---|---|---|
| JP | 2001-190718 | A | 7/2001 |
| JP | 2004-519284 | A | 7/2004 |

* cited by examiner

*Primary Examiner* — Michael Dennis
(74) *Attorney, Agent, or Firm* — Birch, Stewart, Kolasch & Birch, LLP

(57) ABSTRACT

A golf club head (1) has a hollow structure provided on a heel side thereof with a hosel portion (7) having a shaft inserting hole. The hollow structure comprises a main frame (1A) made of at least one kind of metal material and a rear casing (1C) made of a fiber reinforced resin and fixed to the main frame. The main frame comprises: the hosel portion; a front section (8) extending from the hosel portion toward a club face (2A) for hitting a ball and toward a toe side of the golf club head; and a rear section (9) extending from the hosel portion toward a back face of the golf club head and toward the toe side of the golf club head while keeping a distance (L3) in the front-back direction of the golf club head from the front section (8).

25 Claims, 8 Drawing Sheets

GOLF CLUB HEAD AND GOLF CLUB

BACKGROUND OF THE INVENTION

The present invention relates to a golf club and a golf club head, more particularly to a structure of a metal part of a metal/FRP hybrid golf club head capable of improving directional stability of hit balls while keeping a lid on the production cost of the golf club head.

In recent years, in order to improve directional stability of hit balls, a metal/FRP hybrid golf club head has been proposed wherein a resin member made of a fiber reinforced resin is employed in the sole portion, crown portion or the like of the golf club head to obtain a weight margin and then a high specific gravity member is added at a desired position to improve the position of the center of gravity of the golf club head, the moment of inertia of the golf club head and the like.

In Japanese Patent Application Publication Nos. 2001-190718 and 2004-519284, as shown in FIG. 8(*a*) and FIG. 8(*b*), a high specific gravity metal member (d) is embedded in a rear part of one of resin members (c) forming a side portion (b) of the golf club head (a). In such a golf club head structure, an increase in the production cost is inevitable. Further, the resin member receives a large inertia force of the metal member (d) when hitting a ball, therefore, there is a possibility that the durability of the resin member is decreased.

SUMMARY OF THE INVENTION

It is therefore an object of the present invention to provide a golf club head and a golf club, in which the golf club head can be improved in the directional stability of hit balls and the durability of the head is improved while keeping a lid on the production cost of the golf club head.

According to the present invention, a golf club head has a hollow structure provided on a heel side thereof with a hosel portion having a shaft inserting hole, the hollow structure comprising a main frame made of at least one kind of metal material and a rear casing made of a fiber reinforced resin and fixed to the main frame, the main frame comprising the hosel portion, a front section extending from the hosel portion toward a club face for hitting a ball and toward a toe side of the golf club head, and a rear section extending from the hosel portion toward a back face of the golf club head and toward the toe side of the golf club head while keeping a distance in the front-back direction of the golf club head from the front section.

According to the present invention, a golf club comprises a golf club shaft and the above-mentioned golf club head attached to the tip end of the golf club shaft.

Further, the golf club head according to the present invention may be provided with the following optional features:

the front section and the rear section are respectively positioned on the front side and rear side of a vertical axis passing through the center of gravity of the golf club head;

the rear section comprises a thick part including the backmost end of the main frame and having a thickness largest in the main frame excepting the hosel portion;

the front section extends backward from the peripheral edge of the club face and terminates on the front side of the center of gravity of the golf club head;

the rear section includes at least a part of the sole portion, and at least a part of the side portion;

the main frame is provided with an opening, and the main frame includes a face plate covering the opening and forming at least a part of the club face;

the rear casing has a cup-shaped structure provided at the front thereof with an opening into which the rear section is inserted so that the rear section is covered with the rear casing, and a front edge part of the rear casing around the opening is fixed to the front section; and the inner surface of a rear part of the rear casing abuts on the outer surface of the rear section.

In this application including the description and claims, dimensions, positions, directions and the like relating to the golf club head refer to those under a standard state of the golf club head unless otherwise noted.

Here, the standard state of the golf club head is such that the golf club head is set on a horizontal plane HP so that the axis CL of the club shaft (not shown) is inclined at its lie angle alpha while keeping the axis CL on a vertical plane VP, and the club face 2A at the sweet spot SS forms its loft angle beta (more than zero degree) with respect to the horizontal plane HP (the face angle is zero). Incidentally, in the case of the golf club head alone, the center line of the shaft inserting hole can be used instead of the axis of the club shaft.

"Front-back direction" is a direction TH parallel with a straight line N projected on the horizontal plane HP, wherein the straight line N is drawn normally to the club face 2A passing through the center of gravity G of the golf club head.

"Toe-heel direction" is a direction TK parallel with the horizontal plane HP and perpendicular to the front-back direction TH.

BRIEF DESCRIPTION OF THE DRAWINGS

FIG. 7(*b*) is an exploded perspective view of a golf club head as a still another embodiment of the present invention.

DESCRIPTION OF THE PREFERRED EMBODIMENTS

Figure 1:
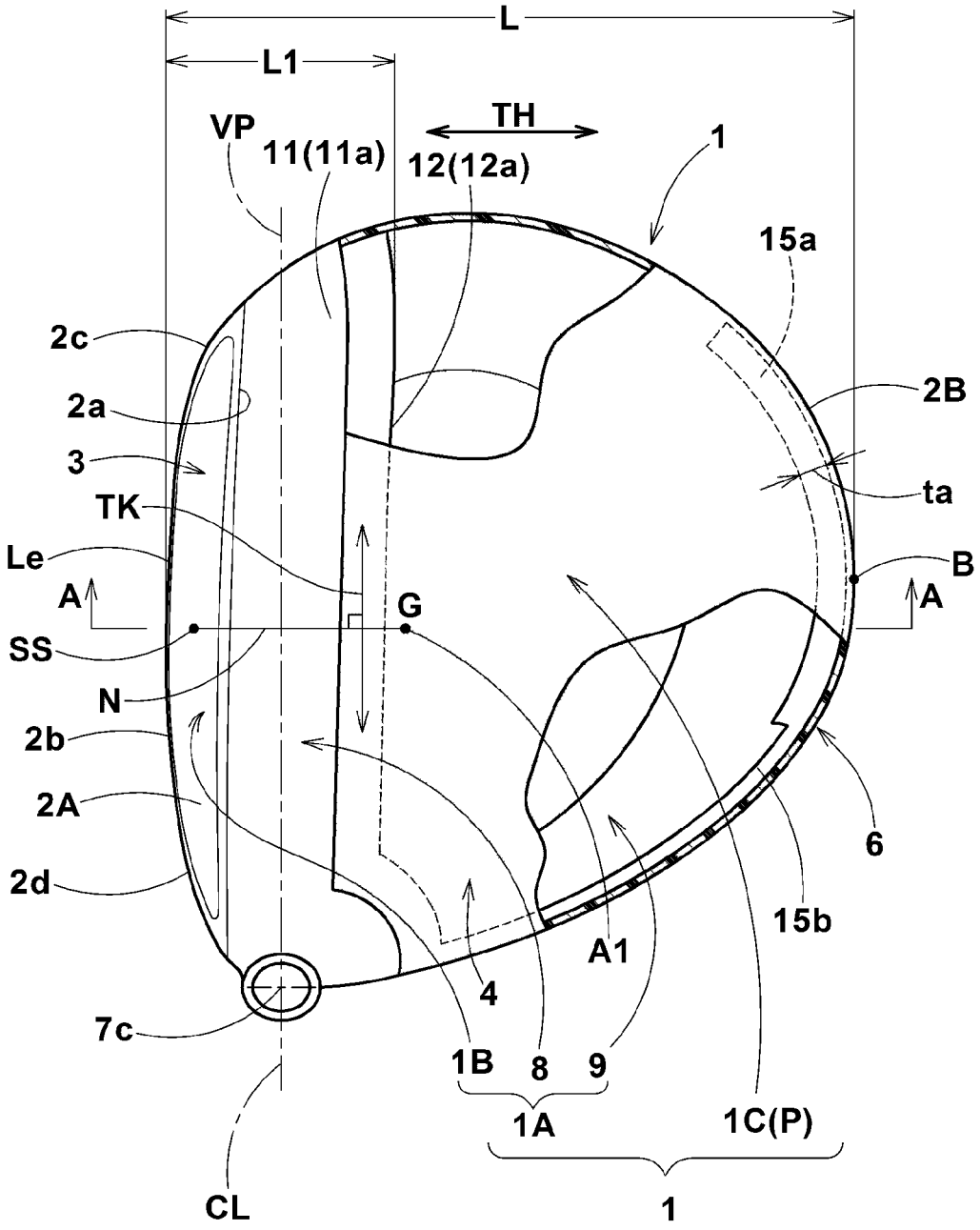
FIG. 1 is a plan view of a golf club head as an embodiment of the present invention.
Figure 2:
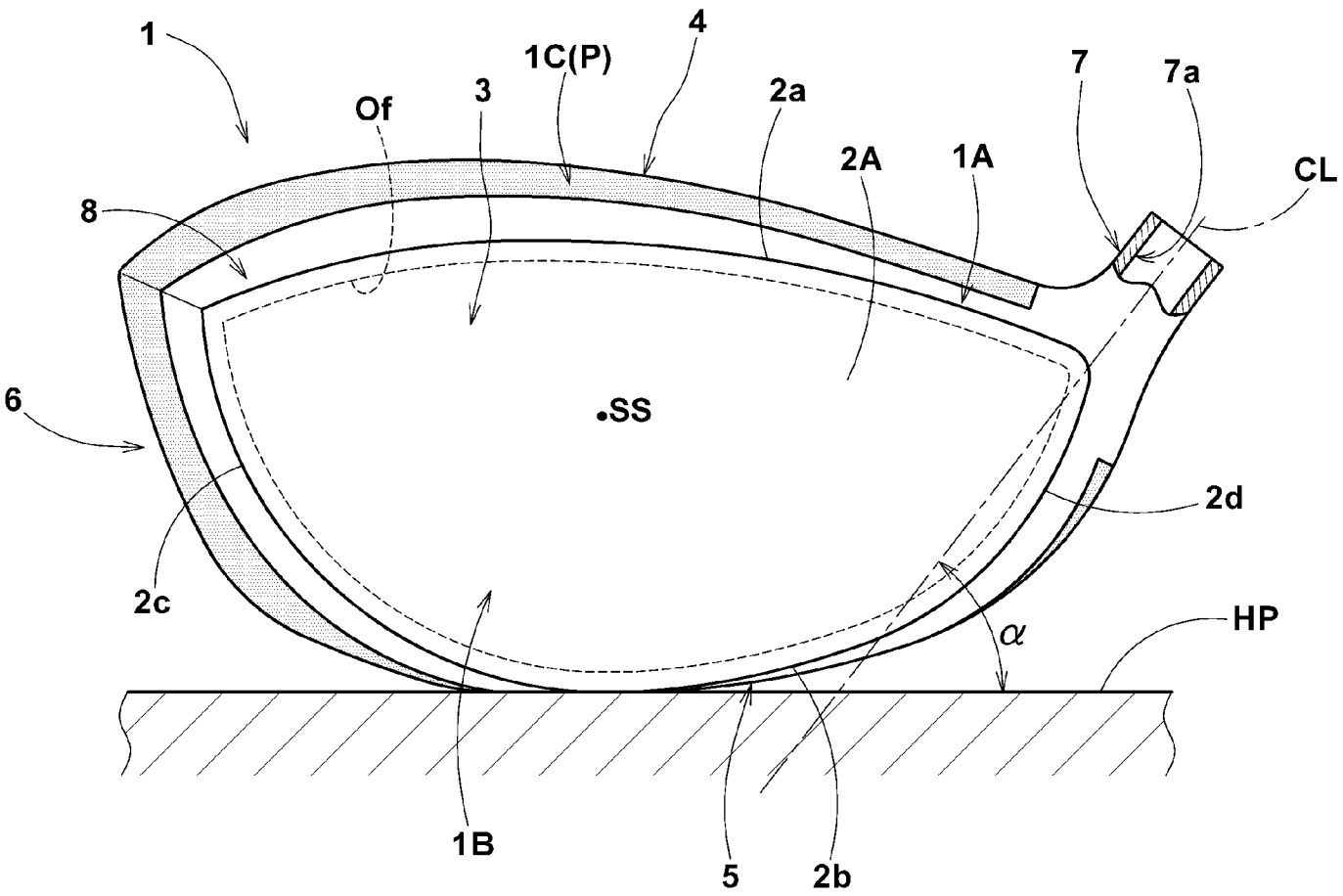
FIG. 2 is a front view of the golf club head.

Embodiments of present invention will now be described in detail conjunction with accompanying drawings.

In the drawings, golf club head 1 according to the present invention has a face portion 3 whose front surface defines a club face 2A for hitting a ball, a crown portion 4 extending to an upper edge 2*a* of the club face 2A and defining a top surface of the golf club head, a sole portion 5 extending to a lower edge 2*b* of the club face 2A and defining a bottom surface of the golf club head, a side portion 6 between the crown portion 4 and the sole portion 5 extending from a toe-side edge 2*c* to a heel-side edge 2*d* of the club face 2A through the back face 2B of the golf club head, and a tubular hosel portion 7 positioned in a heel side of the crown portion 4 and having a shaft inserting hole 7*a*. The tip end of a club shaft (not shown) is inserted in the shaft inserting hole 7*a* and fixed to the golf club head 1 to make a golf club.

The present invention is suitably applied to wood-type golf club heads. The term "wood-type" is meant for at least driver (#1 wood), brassie (#2 wood), spoon (#3 wood), baffy (#4-wood) and cleek (#5-wood) and further club heads having shapes similar to the foregoing but different in number or name.

In the case of a wood-type golf club head, from the point of view of the depth of the center of gravity and the moment of inertia of the golf club head 1, it is preferred that the volume v of the golf club head 1 is not less than 350 cc, more preferably not less than 380 cc. However, it is preferable that the volume v is not more than 460 cc in order to comply with Golf rules and not to increase the golf club head weight excessively, and in view of the swing balance.

If the weight W of the golf club head 1 is excessively light, the kinetic energy of the golf club head decreases, and it becomes difficult to increase the carrying distance of the ball. If the weight W is too heavy, it becomes difficult to swing through the ball, and there is a tendency that the directional stability of hit balls and the flying distance become worse. In this light, the weight W of the golf club head 1 is preferably set in a range of not less than 180 g, more preferably not less than 190 g, but not more than 210 g, more preferably not more than 200 g.

According to the present invention, the golf club head 1 has a hollow structure having a hollow (i) and composed of a main frame 1A having the club face 2A and a rear casing 1C fixed to the main frame 1A.

The main frame 1A includes the above-mentioned the hosel portion 7 and further includes a front section 8 extending from the hosel portion 7 toward the club face 2A and toward the toe, and a rear section 9 extending from the hosel portion 7 toward the back face 2B and toward the toe.

In the embodiment shown in FIGS. 1-6, the main frame 1A is provided with an opening (Of) opened in the face portion 3, and the main frame 1A includes a face plate 1B closing the opening (Of).

Figure 7A:
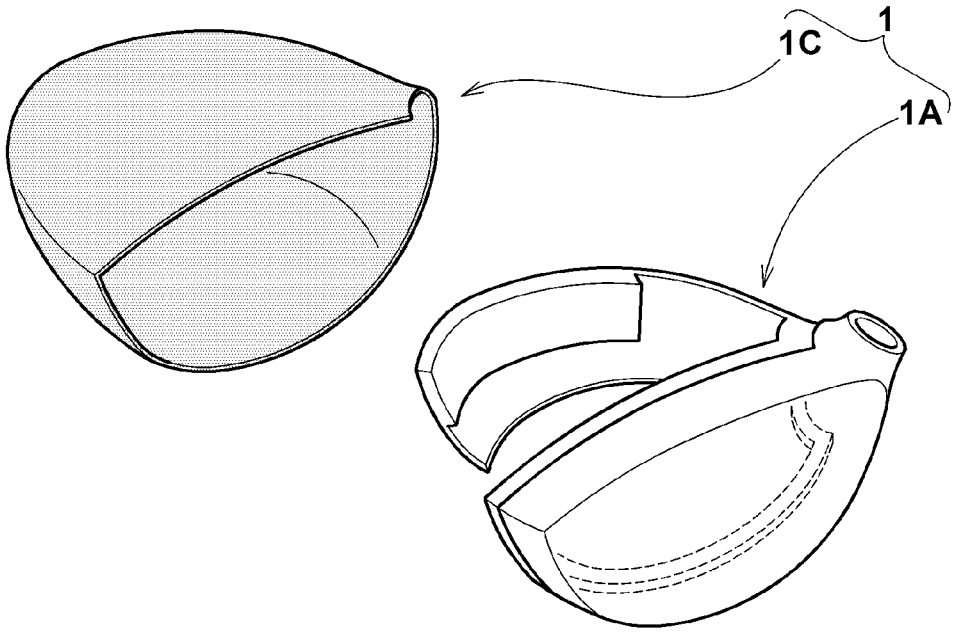
FIG. 7(*a*) is an exploded perspective view of a golf club head as another embodiment of the present invention.
Figure 7B:
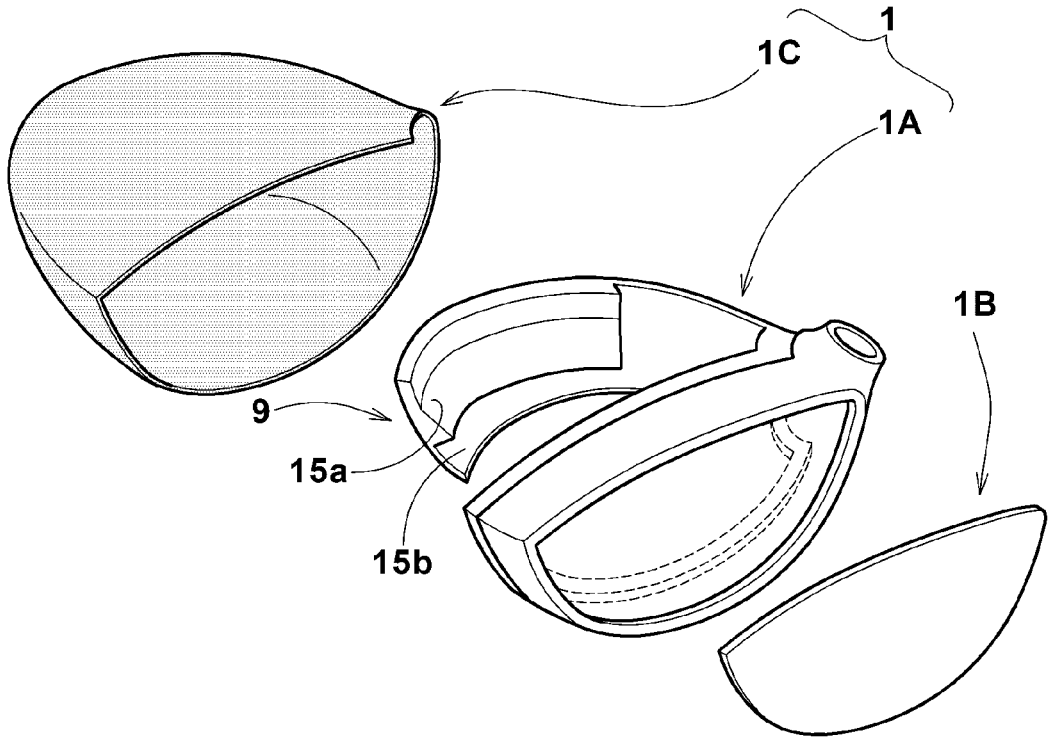

However, as shown in FIG. 7(*a*), it is also possible to make the main frame 1A so as to integrally include the face plate 1B without providing the opening (Of) in order to further reduce the production cost.

The opening (Of) is provided in the front section 8, and in this example the opening (Of) is formed within the face portion 3 leaving space between the edge of the opening (Of) and the peripheral edge (2*a*-2*d*) of the club face 2A. It is preferable that the contour of the opening (Of) extends smoothly and substantially parallel with the peripheral edge (2*a*-2*d*), although the opening (Of) is not limited to such contour.

The front section 8 comprises a flange 11 extending backward from the peripheral edge (2*a*-2*d*) of the club face 2A, and a clubface edge part 10 extending from the peripheral edge (2*a*-2*d*) toward the sweet spot SS and extending annularly around the opening (Of) to have a substantially constant width.

Thus, in this example, the clubface edge part 10 and the flange 11 are connected with each other at the peripheral edge (2*a*-2*d*) and through the hosel portion 7. The front section 8 is annular having a through hole penetrating in the front-back direction.

The flange 11 comprises a crown fore part 11*a* forming a fore part of the crown portion 4, a sole fore part 11*b* forming a fore part of the sole portion 5, a toe fore part 11*c* forming a toe-side fore part of the side portion 6, and a heel fore part 11*d* forming a heel-side fore part of the side portion 6.

The rear edge 12 of the flange 11 (in this example, its entire length) is positioned on the front side of the center of gravity G of the golf club head in view of the strength and possible weight margin.

Figure 5:
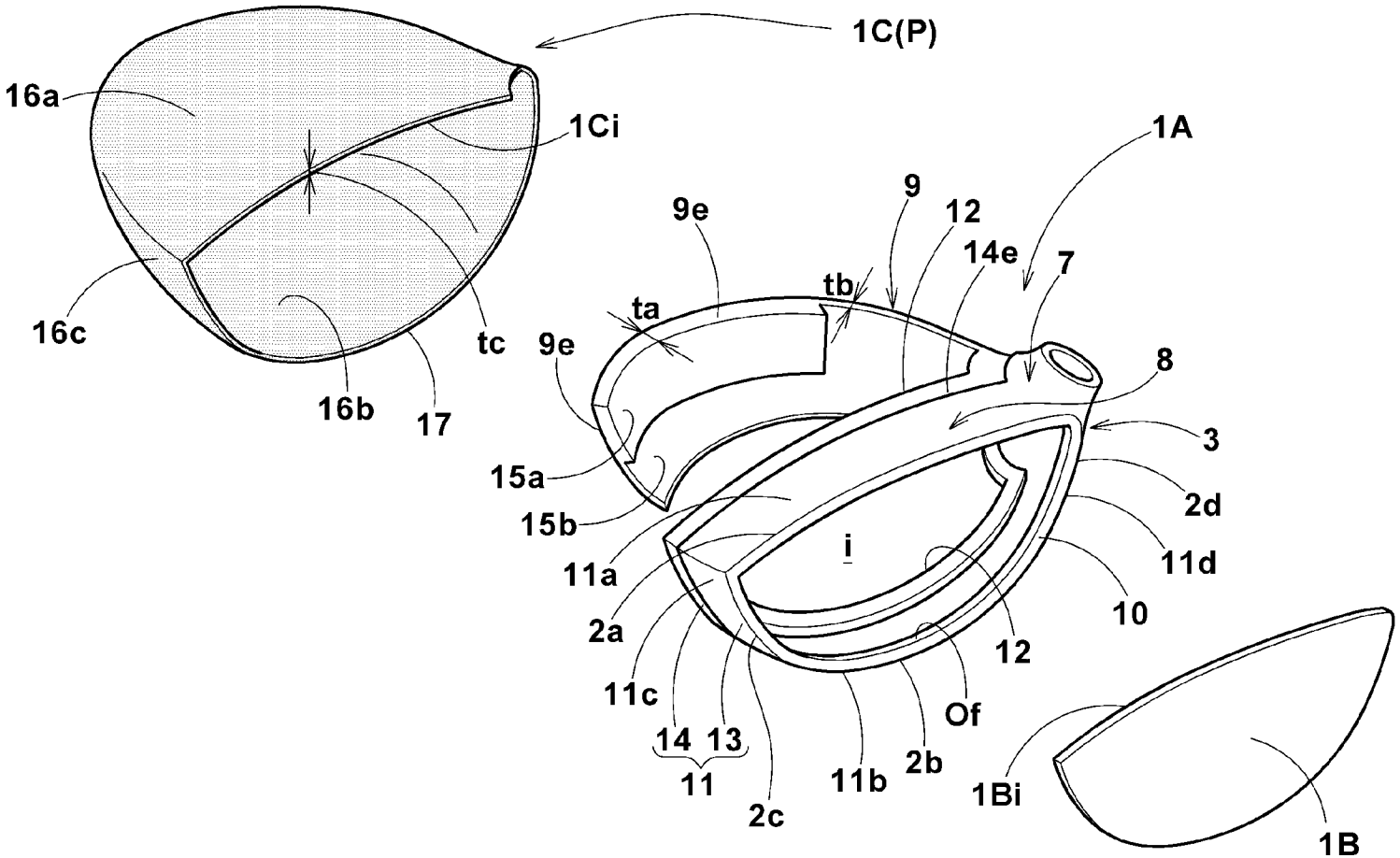
FIG. 5 is an exploded perspective view of the golf club head.

Further, as shown in FIG. 5, the flange 11 comprises a main portion 13 of which outer surface forms a part of the finished outer surface of the golf club head 1 and which extends along the peripheral edge (2*a*-2*d*), and a receiving portion 14 which extends backward from the rear edge of the main portion 13 and of which outer surface sinks from that of the main portion 13 steppedly to form a step.

This step corresponds to the thickness of the after-mentioned front edge portion of the rear casing 1C around the opening 17.

The receiving portion 14 extends along the rear edge 12 of the flange 11 of the front section 8 to have a certain width in the front-back direction.

Figure 3:
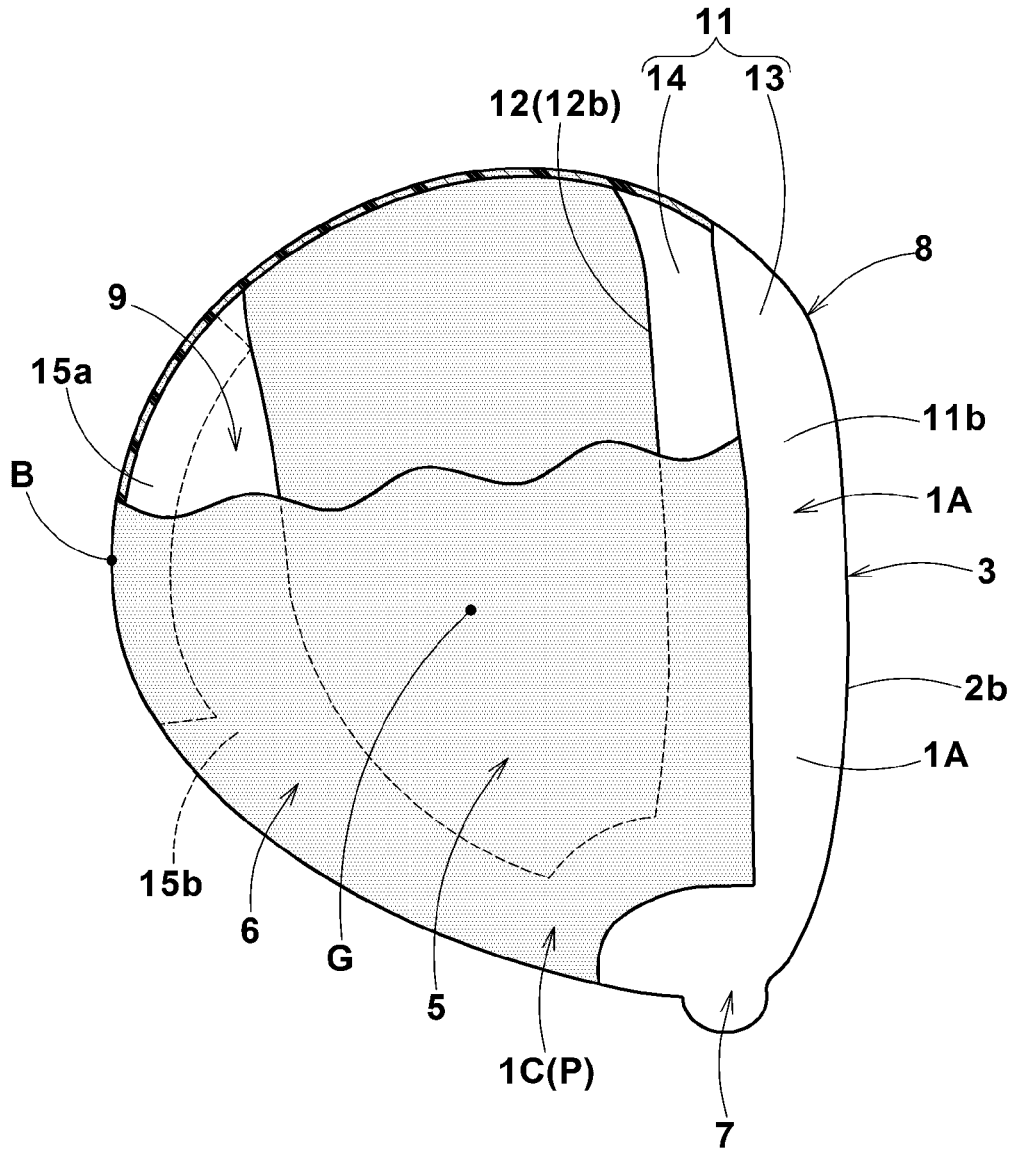
FIG. 3 is a bottom view of the golf club head.

In this embodiment, in the top view, as shown in FIG. 1, the rear edge 12*a* of the crown fore part 11*a* extends along the toe-heel direction, and in the bottom view, as shown in FIG. 3, the rear edge 12*b* of the sole fore part 11*b* extends along the lower edge 2*b* of the club face 2A. As a result, the crown fore part 11*a* and sole fore part 11*b* can distribute shocks at impact uniformly in the toe-heel direction, and it is possible to provide rigidity for the golf club head 1.

In order to effectively derive the effects described above, the maximum distance L1 measured in the front-back direction between the rear edge 12*a* of the crown fore part 11*a* and the leading edge Le of the golf club head is preferably set to be not less than 25%, more preferably not less than 30% of the golf club head length L which is a maximum distance measured in the front-back direction between the leading edge Le and the backmost point of the golf club head.

on the other hand, if the maximum distance L1 is increased, there is a possibility that the directional stability of hit balls is deteriorated due to the increased weight of the golf club head 1. Therefore, the maximum distance L1 is preferably not more than 40%, more preferably not more than 35% of the golf club head length L.

Figure 6:
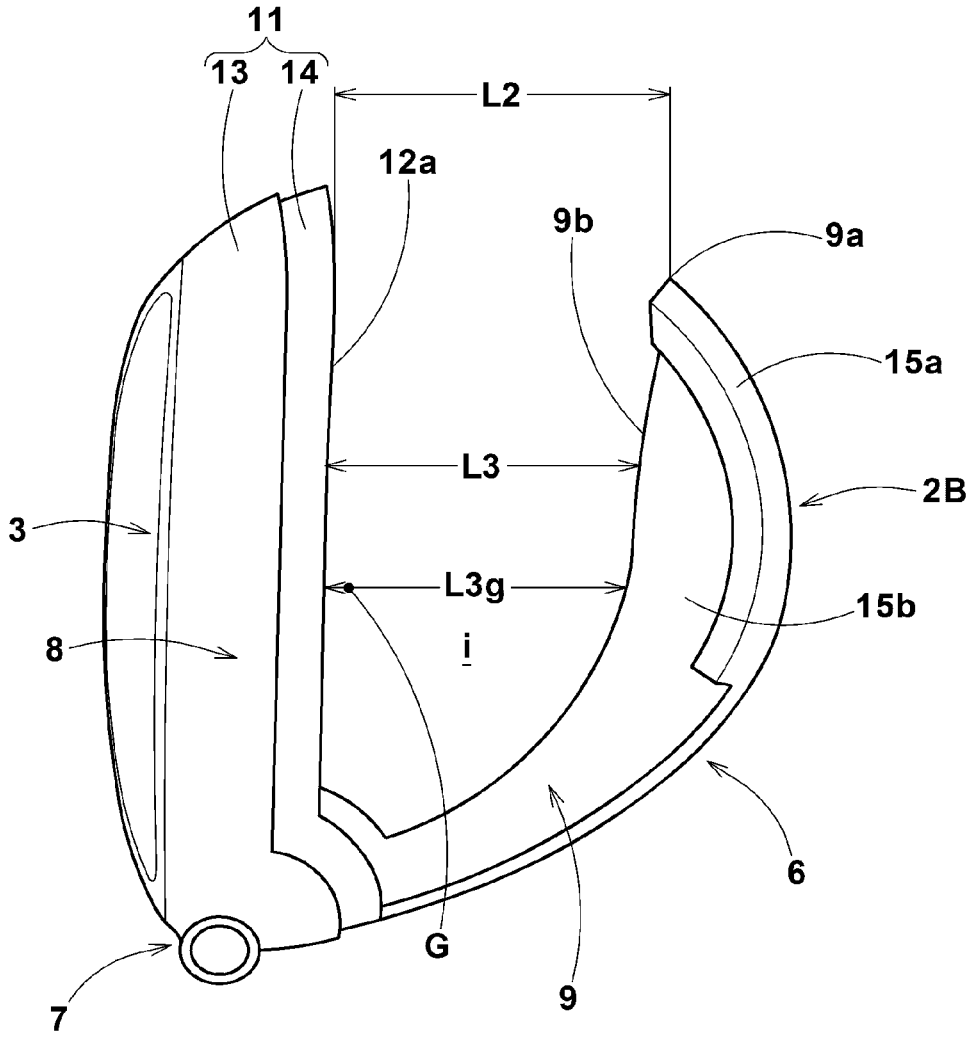
FIG. 6 is a plan view of the main frame of the golf club head.

The above-mentioned rear section 9 extends backward from the hosel portion 7 and then toward the toe along the contour of the golf club head 1 and terminates without reaching to the front section 8 on the toe side so that, in the plan view, the rear section 9 has a substantially crescent shape as shown in FIG. 6. Therefore, the rear section 9 can shift back the center of gravity G of the golf club head.

The rear section 9 in this example includes at least a part of the sole portion 5 and at least a part of the side portion 6. However, none of the crown portion 4 is included therein. Therefore, the rear section 9 serves to further lower the position of the center of gravity G of the golf club head while maintain the strength of the golf club head.

As shown in FIG. 6, on the toe side of the golf club head, the rear section 9 and front section 8 are spaced apart from each other in the front-back direction, although, on the heel side, the front section 8 is connected with the rear section 9 through the hosel portion 7.

Therefore, the main frame 1A can shift the position of the center of gravity of the golf club head toward the heel owing to its weight reduction on the toe side.

Accordingly, during down swing, the golf club head 1 becomes easy to return to its correct address position at impact, and as a result, the directional stability of hit balls can be improved. Further, the rear section 9 functions a weight member to shift the center of gravity G backward.

The rear section 9 is formed integrally with the hosel portion 7, therefore it can not drop out of the rear casing 1C.
Thus, the golf club head 1 can be manufactured, keeping a lid on the production cost.

In order to effectively derive the effects described above, in the plan view, the shortest distance L2 measured in the front-back direction between the rear edge 12*a* of the crown fore part 11*a* and the toe-side extreme end 9*a* of the rear section 9 is preferably set to be not less than 30%, more preferably not less than 40% of the golf club head length L. On the other hand, if the shortest distance L2 is excessively increased, there is a possibility that the durability of the golf club head decreases. Therefore, the shortest distance L2 is preferably set to be not more than 55%, more preferably not more than 50% of the golf club head length L.

The vertical axis A1 (shown in FIG. 4) passing through the center of gravity G of the golf club head is positioned between the front section 8 and the rear section 9.
When measured, in the plan view, along the front-back direction, passing through the center of gravity G of the golf club head, it is preferable that the distance L3*g* between the rear edge 12*a* of the crown fore part 11*a* of the front section 8 and the front edge 9*b* of the rear section 9 is 15 to 40 mm.
Therefore, it becomes possible to shift the center of gravity G of the golf club head backward in order to increase the depth GH of the center of gravity G of the golf club head or the horizontal distance between the center of gravity and the leading edge Le. Thus, the unwanted rotation or motion of the golf club head on off-center shots can be minimized to stabilize the direction of the hit ball.

It is preferable that the distance L3 in the front-back direction between the rear edge 12*a* of the crown fore part 11*a* of the front section 8 and the front edge 9*b* of the rear section 9 is gradually increased from the heel side to the toe side in order to further shift the center of gravity G backward and also toward the heel-side and thereby further improve the directional stability of hit balls.

Preferably, the area of the main frame 1A projected on the horizontal plane HP is set in a range of not less than 40%, preferably 50%, but not more than 70% of the area of the golf club head 1 projected on the horizontal plane HP.

It is preferable that the rear section 9 is composed of a thick part 15*a* having a thickness (ta) which is largest in the main frame 1A excepting the hosel portion 7, and
a thin part 15*b* having a thickness less than the thickness (ta) of the thick part 15*a*, and
the thick part 15*a* is curved along a rear part of the side portion 6 to preferably include the backmost end B of the main frame in order to increase the depth GH of the center of gravity of the golf club head.

Preferably, the thickness (ta) is set in a range of not less than 3.0 mm, more preferably not less than 4.0 mm, but not more than 7.0 mm, more preferably not more than 6.0 mm in order to effectively derive the effect described above.

It is preferable that the weight W1 of the thick part 15*a* is set in a range of not less than 5%, more preferably not less than 7%, but not more than 10%, more preferably not more than 8% of the overall weight W of the golf club head 1.

Preferably, the thickness (ta) of the thick part 15*a* is not less than 3 times the minimum thickness (tb) of the thin part 15*b*.

In the embodiment shown in FIGS. 1-6 and the embodiment shown in FIG. 7(*a*), the thickness (ta) of the thick part 15*a* is substantially constant.

However, it is also possible that the thick part 15*a* has a variable thickness (ta) for example as shown in FIG. 7(*b*). In this example, the rear section 9 is made such that the thickness (ta) of the thick part 15*a* gradually increases from the crown-side towards the sole-side in order to lower the center of gravity without increasing the entire weight of the thick part 15*a*. In this figure, the maximum thickness occurs at an intermediate position of the height of the rear section 9.

In the embodiments shown in FIGS. 1-6, 7(*a*) and 7(*b*), the thick part 15*a* extends between its toe-side end and heel-side end while having a substantially constant height H1.

However, it is also possible that the thick part 15*a* has such a variable height H1 that increases from the toe-side end and heel-side end of the thick part 15*a* toward the backmost end B of the golf club head.

Further, in the embodiments shown in FIGS. 1-6, 7(*a*) and 7(*b*), the thick part 15*a* extends from the upper edge of the rear section 9 toward the lower edge but ends without reaching to the lower edge of the rear section 9.

However, it is also possible to make the rear section 9 so that the thick part 15*a* extends to the lower edge of the rear section 9 from the upper edge of the rear section 9 or from a lower position than the upper edge of the rear section 9 in order to lower the center of gravity G of the golf club head.

The main frame 1A is made of one or more kinds of metal materials, e.g. stainless steels, maraging steels, titanium, titanium alloys, amorphous alloys and the like.

The main frame 1A can be manufactured by assembling two or more metal parts made by suitable methods such as forging, casting, pressing, rolling and the like and integrating them into one for example by the use of welding.
It is however, preferable that the main frame 1A (regardless of with or without the opening (Of)) is produced integrally in the first place by means of, for example, casting in view of the production cost reduction.

The above-mentioned face plate 1B in this example is as shown in FIG. 5, a flat or slightly curved plate made of a titanium alloy having a high specific strength for example Ti-15V-6Cr-4Al, Ti-6Al-4V and the like.
The face plate 1B forms at least a major part (60% or more) of the club face 2A including the sweet spot SS.

It is preferable that the face plate 1B is fixed to the main frame 1A by means of laser welding in order to minimize the heat-affected zone and not to decrease the strength of the face plate 1B.

The above-mentioned rear casing 1C is a cup-shaped shell-like structure having a single opening 17 at the front thereof. The rear casing 1C extend from the backmost end B toward the club face to have a crown aft part 16*a* forming an aft part of the crown portion 4, a sole aft part 16*b* forming an aft part of the sole portion 5, and a side aft part 16*c* forming an aft part of the side portion 6.

The rear section 9 of the main frame 1A is inserted into the opening 17, and the outside of the rear section 9 is covered with the rear casing 1C.

Figure 4:
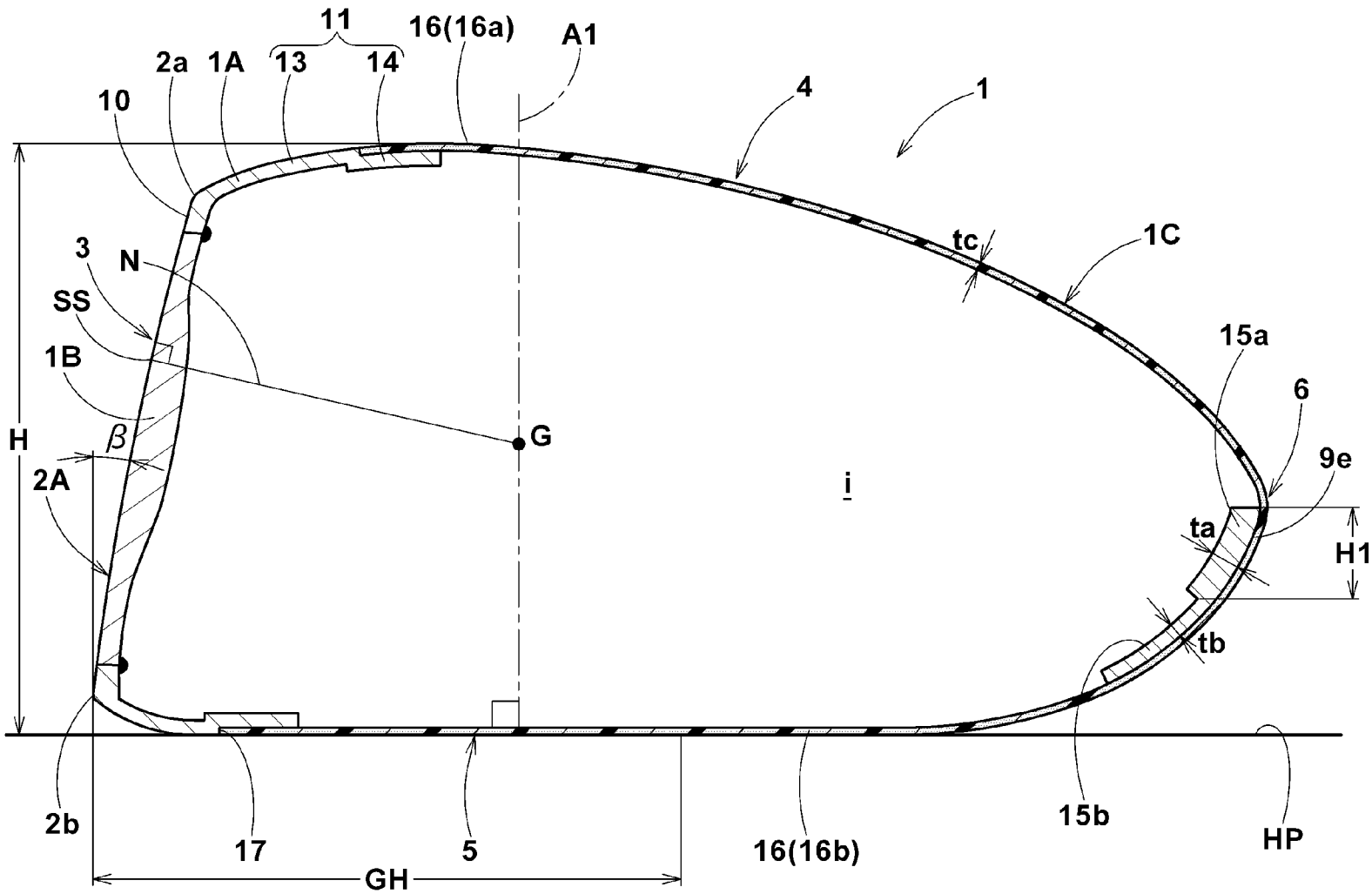
FIG. 4 is a cross sectional view of the golf club head taken along line A-A in FIG. 1.

The front edge portion of the rear casing 1C around the opening 17 is fixed to the receiving portion 14 of the front section 8. Incidentally, the dimension of the outer surface 14*e* of the receiving portion 14 is substantially same as (slightly smaller than) the dimension of the inner surface 1Ci of the front edge portion of the rear casing 1C.
AS shown in FIG. 4, the inner surface 1Ci of a rear part of the rear casing 1C substantially contacts with the outer surface 9*e* of the rear section 9. These surfaces can be bonded with each other.

The rear casing 1C has the same thickness (tc) in all of the crown aft part 16*a*, the sole aft part 16*b* and the side aft part 16*c*.

However, the rear casing is may have a variable thickness. For example, the sole aft part 16*b* may have a larger thickness than the crown aft part 16*a* and the side aft part 16*c* in order to increase the durability of the sole portion 5 which often contact with the ground.

The rear casing 1C is a FRP-part P made of a fiber reinforced resin having a specific gravity less than the specific gravity of any of the metal materials for the main frame 1A. Incidentally, the fiber reinforced resin is a composite material comprising a matrix resin and reinforcing fibers.

As to the matrix resin, a thermoset resin or a thermoplastic resin may be used. In view of strength, thermoset resins, e.g. epoxide resins, unsaturated polyester resins, phenol resins and the like are preferably used.

As to the reinforcing fibers, for example, carbon fiber, glass fiber, aramid fiber, titanium fiber and the like can be used alone or in combination of two or more kinds.

The FRP-part P may be manufactured by various methods, e.g. prepreg method, fixing molding method and all the rest. But, in view of the production cost, preferably employed is a prepreg method in which 2 to 10 prepreg sheets are laminated and molded into the desired shape by applying heat and pressure.

Comparison Tests

Figure 8A:
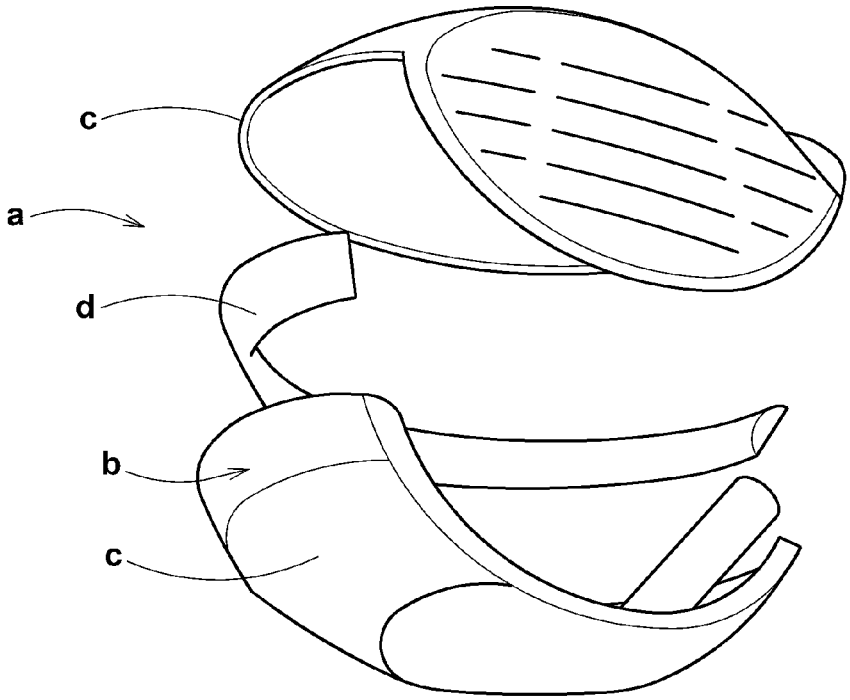
FIGS. 8(*a*) and 8(*b*) are an exploded perspective view and a cross sectional view of the golf club head according to a prior art.
Figure 8B:
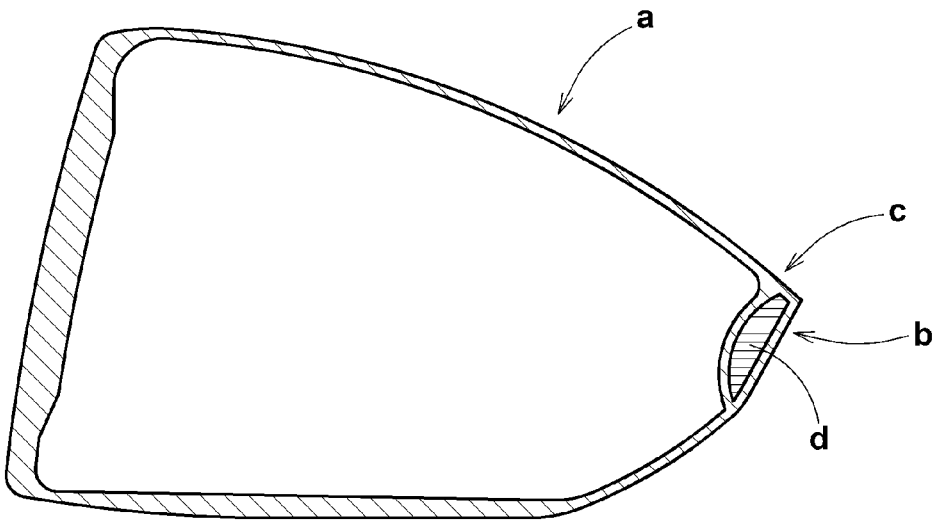

Wood-type golf club heads for driver were experimentally manufactured based on the structures shown in FIG. 5, FIG. 7(*a*), FIG. 7(*b*) and FIG. 8. The golf club heads had the same specifications except for specifications shown in Table 1. Common major specifications are as follows.

club head weight: 195 g metal material for metal parts (main frame, face plate, etc.): a titanium alloy fiber reinforced resin for FRP-parts: epoxide resin and carbon fiber The golf club heads were subjected to comparison tests for the directional stability and production cost as follows.

<Directional Stability Test>

The golf club heads were attached to identical FRP shafts ("MP-600, flex R" manufactured by SRI sports Limited) to make 45-inch wood clubs. Ten right-handed golfers (handicap ranging from 5 to 25) struck ten balls with each club, to measure the amount (in meter) of rightward or leftward swerve from the intended target trajectory of the ball, at the position corresponding to a carry distance of 200 yards, wherein the amount of swerve is treated as a positive value regardless of whether the swerve is rightward or leftward.

The results of measurement of the amount of swerve are shown in Table 1 as the average values obtained by striking 100 balls (10×10) for each club. The smaller the value, the better the directional stability.

<Production Cost>

The production cost of each head was evaluated by man-hour without including materials' costs. The results are indicated in Table 1 by an index based on Ref.1 being 100, wherein the smaller the index number, the lower the cost.

TABLE 1

| Head | Ref. 1 | Ex. 1 | Ex. 2 | Ex. 3 | Ex. 4 | Ex. 5 | Ex. 6 | Ex. 7 |
|---|---|---|---|---|---|---|---|---|
| structure (FIG. No.) | 8 | 5 | 5 | 5 | 5 | 5 | 7(a) | 7(b) |
| thick part weight W1/W (%) | — | 7.7 | 3 | 5 | 10 | 12 | 7.7 | 7.7 |
| directional stability (m) | 15 | 2 | 10 | 6 | 4 | 8 | 2 | 2 |
| production cost | 5 | 2 | 2 | 2 | 3 | 3 | 2 | 2 |

As apparent from the test results, the directional stability can be improved while reducing the production cost.

The invention claimed is:

1. A golf club head having a hollow structure provided on a heel side thereof with a hosel portion having a shaft inserting hole, the hollow structure comprising a main frame made of at least one kind of metal material and a rear casing made of a fiber reinforced resin and fixed to the main frame, the main frame including said hosel portion and further including a front section and a rear section, wherein the front section extends from the hosel portion through a club face for hitting a ball and toward a toe side of the golf club head, and the rear section extends from the hosel portion through a back face of the golf club head and toward the toe side of the golf club head while keeping a distance in the front-back direction of the golf club head from the front section and terminates without reaching to the front section so that the front section and the rear section are connected to each other at only the hosel portion.

2. The golf club head according to claim 1, wherein a vertical axis passing through the center of gravity of the golf club head under its standard state is positioned between the front section and the rear section.

3. The golf club head according to claim 1, wherein the rear section comprises a thick part including a backmost end of the main frame and having a thickness largest in a part of the main frame excluding the hosel portion.

4. The golf club head according to claim 2, wherein the rear section comprises a thick part including a backmost end of the main frame and having a thickness largest in a part of the main frame excepting the hosel portion.

5. The golf club head according to claim 2, wherein the front section extends backward from the peripheral edge of the club face and terminates on the front side of the center of gravity of the golf club head.

6. The golf club head according to claim 3, wherein the front section extends backward from the peripheral edge of the club face and terminates on the front side of the center of gravity of the golf club head.

7. The golf club head according to claim 4, wherein the front section extends backward from the peripheral edge of the club face and terminates on the front side of the center of gravity of the golf club head.

8. The golf club head according to claim 1, wherein the head comprises a crown portion defining an upper surface of the golf club head, a sole portion defining a bottom face of the golf club head, and a side portion extending between the crown portion and the sole portion, and the rear section includes at least a part of the sole portion, and at least a part of the side portion.

9. The golf club head according to claim 1, wherein the main frame is provided with an opening, and the main frame includes a face plate covering the opening and forming at least a part of the club face.

10. The golf club head according to claim 1, wherein the rear casing has a cup-shaped structure provided at the front thereof with an opening into which the rear section is inserted so that the rear section is covered with the rear casing and a front edge part of the rear casing around the opening is fixed to the front section.

11. The golf club head according to claim 8, wherein the rear casing has a cup-shaped structure provided at the front thereof with an opening into which the rear section is inserted so that the rear section is covered with the rear casing and a front edge part of the rear casing around the opening is fixed to the front section.

12. The golf club head according to claim 9, wherein the rear casing has a cup-shaped structure provided at the front thereof with an opening into which the rear section is inserted so that the rear section is covered with the rear casing and a front edge part of the rear casing around the opening is fixed to the front section.

13. The golf club head according to claim 10, wherein the inner surface of a rear part of the rear casing abuts on the outer surface of the rear section.

14. The golf club head according to claim 11, wherein the inner surface of a rear part of the rear casing abuts on the outer surface of the rear section.

15. The golf club head according to claim 12, wherein the inner surface of a rear part of the rear casing abuts on the outer surface of the rear section.

16. The golf club head according to claim 1, wherein an area of the main frame if the main frame is projected on a horizontal plane is in a range of not less than 40%, but not more than 70% of an area of the golf club head if the golf club head is projected on the horizontal plane.

17. A golf club comprising a golf club shaft and the golf club head as set forth in claim 1.

18. The golf club head according to claim 1, wherein the rear section has a substantially crescent shape in a plan view of the main frame.

19. The golf club head according to claim 1, wherein the front section and the rear section are arranged in a V-shape in a plan view of the main frame.

20. The golf club head according to claim 1, wherein the rear section comprises a thin part and a thick part including the backmost end of the main frame, the thick part has a substantially constant thickness of not less than 3 times a minimum thickness of the thin part, and the thick part extends from an upper edge toward a lower edge of the rear section and ends without reaching to the lower edge of the rear section.

21. The golf club head according to claim 1, wherein in a plan view of the main frame, the shortest distance measured in a front-back direction between a toe-side extreme end of the rear section and a rear edge of the crown fore part is not less than 30% and not more than 55% of the golf club head length which is a maximum distance measured in a front-back direction between a leading edge and a backmost point of the golf club head.

22. A golf club head having a hollow structure provided in a heel side thereof with a hosel portion having a shaft inserting hole, the hollow structure comprising a main frame made of at least one kind of metal material and a rear casing made of a fiber reinforced resin and fixed to the main frame, the main frame including said hosel portion, a front section and a rear section, the front section extending from the hosel portion through a club face for hitting a ball and toward a toe side of the golf club head, the rear section extending from the hosel portion through a back face of the golf club head and toward the toe side of the golf club head while keeping a distance in the front-back direction of the golf club head from the front section, wherein the front section and the rear section are connected with each other through the hosel portion on the heel side but spaced apart from each other on the toe side.

23. The golf club head according to claim 22, wherein in a plan view of the main frame, the shortest distance measured in a front-back direction between a toe-side extreme end of the rear section and a rear edge of the crown fore part is not less than 30% and not more than 55% of a golf club head length which is a maximum distance measured in a front-back direction between a leading edge and a backmost point of the golf club head.

24. A golf club head having a hollow structure comprising a metallic frame comprising a hosel portion having a shaft inserting hole, a front section forming a club face for hitting a ball, and a rear section, and a fiber-reinforced-resin rear casing covering the rear section, wherein the front section and the rear section are connected to each other through the hosel portion only on the heel side of the main frame such that the front section extends from the hosel portion toward the toe of the head, and the rear section extends from the hosel portion toward the toe and toward a backward portion of the head, while keeping a distance from the front section in a front-back direction of the head along the entire extent of the rear section from its heel-side end connected to the hosel portion to its toe-side free end.

25. The golf club head according to claim 24, wherein the rear section comprises a thick part extending from a backmost end of the main frame toward the toe and toward the heel of the head, and a relatively thin part on an under side of the thick part and on a heel-side of the thick part.

* * * * *